United States Patent [19]

Gunji et al.

[11] 4,275,098

[45] Jun. 23, 1981

[54] METHOD AND APPARATUS FOR CONTINUOUSLY HOT-DIP GALVANIZING STEEL STRIP

[75] Inventors: Naoki Gunji; Saburo Ito, both of Yokohama, Japan

[73] Assignee: Nippon Kokan Kabushiki Kaisha, Tokyo, Japan

[21] Appl. No.: 126,203

[22] Filed: Mar. 3, 1980

[30] Foreign Application Priority Data

Mar. 26, 1979 [JP] Japan ..... 54/34228

[51] Int. Cl.[3] ..... C23C 1/02

[52] U.S. Cl. ..... 427/345; 427/349; 427/433; 427/434.5; 118/419; 118/422; 118/424; 118/429; 118/603; 118/612; 118/620

[58] Field of Search ..... 427/434.5, 433, 345; 118/419, 424, 602, 603, 610, 612, 600, 429, 422

[56] References Cited

U.S. PATENT DOCUMENTS 2,224,578 12/1940 Wean et al. ..... 118/422

2,721,813 10/1955 Holmberg ..... 427/433

*Primary Examiner*—Ralph S. Kendall

*Attorney, Agent, or Firm*—Frishauf, Holtz, Goodman & Woodward

[57] ABSTRACT

A method and an apparatus for continuously hot-dip galvanizing a steel strip, which comprises:

Using a hot-dip galvanizing tank divided into a reaction chamber and a plating chamber having a bottom wall downwardly inclining toward the bottom wall of said reaction chamber, by a vertical partition provided, at the lowermost end thereof, with a gap and, at the upper end portion thereof, with an aperture of which the opening can be adjusted, said reaction chamber and said plating chamber communicating with each other through said gap and said aperture; causing a hot-dip galvanizing bath containing aluminum in a prescribed amount, contained in said hot-dip galvanizing tank, to circulate by convection, under the effect of stirring by a stirring means provided in said reaction chamber, through said gap and said aperture, between said reaction chamber and said plating chamber; continuously introducing a steel strip into said hot-dip galvanizing bath in said plating chamber while continuing said stirring, to subject said steel strip to a hot-dip galvanizing treatment.

7 Claims, 5 Drawing Figures

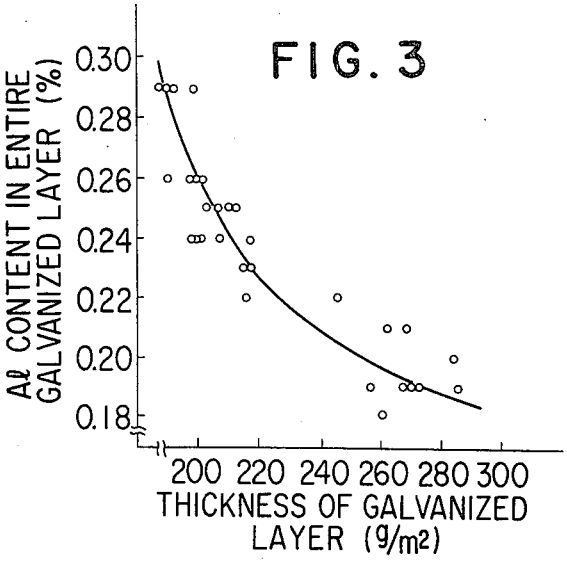
FIG.4
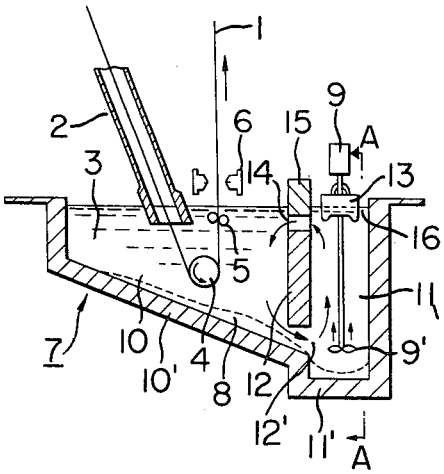
FIG.5
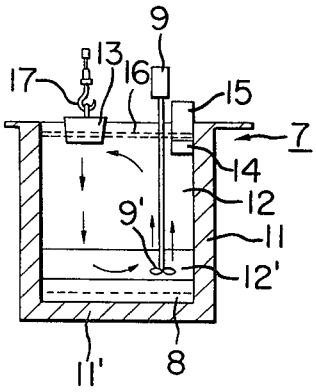

METHOD AND APPARATUS FOR CONTINUOUSLY HOT-DIP GALVANIZING STEEL STRIP

REFERENCE TO PATENTS, APPLICATIONS AND PUBLICATIONS PERTINENT OT THE INVENTION

As far as we know, there is no prior document pertinent to the present invention.

FIELD OF THE INVENTION

The present invention relates to a method and an apparatus for continuously hot-dip galvanizing a steel strip permitting prevention of the occurrence of external defects of a hot-dip galvanized steel strip caused by a bottom dross produced during hot-dip galvanizing treatment of a steel strip and accumulated on the bottom of a hot-dip galvanizing tank containing a hot-dip galvanizing bath, and by nonuniform corrosion of a sink roll, pinch rolls and other devices immersed in the hot-dip galvanizing bath.

BACKGROUND OF THE INVENTION

A steel strip is generally hot-dip galvanized by: introducing a steel strip into a hot-dip galvanizing bath contained in a hot-dip galvanizing tank; upwardly reversing the travelling direction of said steel strip by a sink roll provided in the hot-dip galvanizing bath to introduce said steel strip through a pair of pinch rolls to outside said hot-dip galvanizing bath; and adjusting, immediately above the surface of the hot-dip galvanizing bath, the thickness of a galvanized layer deposited on the surface of said steel strip by a pair of slit nozzles ejecting a gas or any other appropriate means.

In the above-mentioned hot-dip galvanizing treatment, steel (Fe) composing the steel strip, the sink roll, the pinch rolls and other devices immersed in the hot-dip galvanizing bath very actively reacts with molten zinc (Zn). Dissolution of Fe into the hot-dip galvanizing bath is therefore inevitable. More specifically, Fe is dissolved into the galvanizing bath until the hot-dip galvanizing bath is saturated with Fe, i.e., until the Fe concentration in the hot-dip galvanizing bath reaches about 0.03 wt.%, and subsequently, precipitated in the form of an intermetallic compound of Fe and Zn ($FeZn_7$). Said intermetallic compound ($FeZn_7$), having the specific gravity of 7.25 which is larger than the specific gravity of Zn of 7.14, settles and accumulates on the bottom of the hot-dip galvanizing tank. This is why said intermetallic compound is usually known as "bottom dross".

The above-mentioned bottom dross accumulated on the bottom of the hot-dip galvanizing tank curls up through the hot-dip galvanizing bath under the effect of stirring of the hot-dip galvanizing bath caused by the ingression of the steel strip into the hot-dip galvanizing bath, and adheres to the surface of the travelling steel strip in the hot-dip galvanizing bath. As a result, particle-shaped protruding defects are caused by the adherence of bottom dross on the surface of the manufactured hot-dip galvanized steel strip, and seriously impair the appearance of the product.

In order to solve the above-mentioned problem, it has conventionally been a usual practice to temporarily discontinue the hot-dip galvanizing operation when the amount of bottom dross accumulated on the bottom of the hot-dip galvanizing tank reaches a certain value, and to discharge the accumulated dross by bailing it out from the bottom of the galvanizing tank with a bucket. In this method, however, not only the efficiency of discharge is very low, but also decrease in the productivity is inevitable because of the necessity of temporarily discontinuing the hot-dip galvanizing operation. The bottom dross bailed out from the hot-dip galvanizing tank contains Zn in a large quantity, and the recovery of Zn from the bottom dross requires re-refining of bottom dross. A plant not provided with dross re-refining equipment is obliged to sell the bottom dross bailed out from the hot-dip galvanizing bath to refiners, and cannot recover Zn contained in the bottom dross within the plant for reuse, thus leading to an increased zinc consumption.

For discharging bottom dross from a hot-dip galvanizing tank without interrupting the hot-dip galvanizing operation, a method is known, comprising adding aluminum (Al) into the hot-dip galvanizing bath. Addition of Al into the hot-dip galvanizing bath has conventionally applied in general also in an attempt to improve formability of the manufactured hot-dip galvanized steel strip. More particularly, an Fe-Zn alloy layer is formed in the galvanized layer of a hot-dip galvanized steel strip manufactured by hot-dip galvanizing. This Fe-Zn alloy layer, which is hard and brittle, causes, when working the hot-dip galvanized steel strip, breakage of the galvanized layer which results in peeling-off of the galvanized layer. With a view to preventing the above-mentioned Fe-Zn alloy layer from growing too thick and for improving the formability of the hot-dip galvanized steel strip, it is usual, in the hot-dip galvanizing operation, to add from above 0.10 to about 0.40% Al into the hot-dip galvanizing bath.

When Al is added into the hot-dip galvanizing bath, the above-mentioned bottom dross ($FeZn_7$) reacts with Al as follows:

$$2FeZn_7 + 5Al \rightleftharpoons Fe_2Al_5 + 14Zn$$

The reaction given above proceeds from the left side to the right side at a free Al concentration of over 0.12 wt.% in the hot-dip galvanizing bath, and the bottom dross ($FeZn_7$) accumulated on the bottom of the hot-dip galvanizing tank is converted into $Fe_2Al_5$. This $Fe_2Al_5$, having the specific gravity of about 4.5, which is smaller than the specific gravity of Zn of 7.14, floats up onto the surface of the hot-dip galvanizing bath. This is why $Fe_2Al_5$ is generally known as "surface dross". The surface dross can be easily removed from the hot-dip galvanizing tank by scraping out even during the hot-dip galvanizing operation. Therefore, by converting the bottom dross into the surface dross through addition of Al into the hot-dip galvanizing bath so as to always give an Al concentration of over 0.12 wt.%, it is possible to easily remove the bottom dross from the hot-dip galvanizing tank without interrupting hot-dip galvanizing operation.

In an actual operation, however, it is not always easy to remove the bottom dross from the hot-dip galvanizing tank by converting the bottom dross into the surface dross through addition of Al into the hot-dip galvanizing bath and to keep the hot-dip galvanizing bath always in a state with the minimum bottom dross, for the following reasons.

More specifically, in an actual operation, a steel strip to be hot-dip galvanized is continuously introduced into the hot-dip galvanizing bath. The amount of bottom dross accumulated on the bottom of the galvanizing tank therefore increase gradually. In order to keep the amount of bottom dross in the galvanizing tank always at the lowest level, therefore, it is necessary to increase the amount of Al to be added into the hot-dip galvanizing bath. However, when increasing the amount of Al added into the hot-dip galvanizing bath, a reaction between added Al and steel (Fe) composing the steel strip, the sink roll, the pinch rolls and other devices immersed in the hot-dip galvanizing bath, takes place more actively than a reaction between Zn and Fe. Since a considerable portion of added Al is thus consumed in the reaction with Fe, the effect of Al addition to convert the bottom dross into the surface dross is reduced.

In order to keep the galvanizing bath always in a state of the minimum bottom dross in an actual operation, therefore, it is necessary to increase the amount of Al to be added into the hot-dip galvanizing bath, taking into account the amount consumed for the above-mentioned reaction with Fe. Addition of Al into the hot-dip galvanizing bath is usually effected by using a zinc ingot containing Al. In order to effectively prevent the production of bottom dross in the hot-dip galvanizing bath, the Al content in the zinc ingot should be at least 0.45 wt.%, and the free Al concentration of the hot-dip galvanizing bath should be kept at a high level of at least 0.20 wt.%.

However, when carrying out the hot-dip galvanizing operation of a steel strip with the use of a hot-dip galvanizing bath containing Al at such a high concentration, the following problems are encountered:

(1) Steel (Fe) composing the sink roll and the pinch rolls immersed in the hot-dip galvanizing bath actively reacts with Al contained at a high concentration in the hot-dip galvanizing bath, and is nonuniformly corroded. This causes serious irregularities on the surfaces of the sink roll and the pinch rolls, which in turn cause flaws on the surface of the steel strip and/or the surface of the galvanized layer thereof, thus resulting in a seriously impaired product appearance, and even in the impossibility of continuing the operation.

(2) A large quantity of surface dross ($Fe_2Al_5$) is produced in the hot-dip galvanizing tank by the reaction of Fe and Al as mentioned in (1) above. It is possible, as mentioned above, to easily remove the surface dross from the galvanizing tank by scraping out. However, a plant not provided with a re-refining equipment of dross is obliged to sell the surface dross, as in the case of bottom dross, to re-refiners, and cannot recover Zn contained in the surface dross within the plant for reuse.

(3) A large quantity of $Fe_2Al_5$ is produced in the form of a layer in the galvanized layer of the hot-dip galvanized steel strip manufactured with the use of a hot-dip galvanizing bath containing Al at a high concentration. When a large quantity of $Fe_2Al_5$ is present in the galvanized layer, application of a galvannealing treatment (a treatment for converting the entire galvanized layer into a Zn-Fe alloy layer) to the galvanized layer of a hot-dip galvanized steel strip is impaired, and a uniform Zn-Fe layer cannot be obtained. When applying the galvanizing treatment, therefore, it is necessary to reduce the Al concentration in the hot-dip galvanizing bath in advance.

(4) A chemical film serving as the primer is hardly formed on the surface of a galvanized layer containing a large quantity of Al, and it is impossible to obtain satisfactory paint adhesion.

Thus, it is very difficult, in an actual operation, to conduct hot-dip galvanizing with the use of a hot-dip galvanizing bath containing Al at a high concentration. This method is not therefore appropriate as a means to prevent production of the bottom dross.

SUMMARY OF THE INVENTION

A principal object of the present invention is therefore to provide a method and an apparatus of continuously hot-dip galvanizing a steel strip permitting prevention of external defects of a hot-dip galvanized steel strip caused by a bottom dross which is produced during hot-dip galvanizing treatment of a steel strip and accumulated on the bottom of a hot-dip galvanizing tank containing a hot dip-galvanizing bath.

An object of the present invention is to provide a method and an apparatus for continuously hot-dip galvanizing a steel strip permitting prevention of production of external defects of a hot-dip galvanized steel strip caused by non-uniform corrosion of a sink roll, pinch rolls and other devices immersed in a hot-dip galvanizing bath contained in a hot-dip galvanizing tank.

Another object of the present invention is to provide a method and an apparatus for continuously hot-dip galvanizing a steel strip, which poses no problem in a galvannealing treatment of the galvanized layer of a hot-dip galvanized steel strip and a chemical treatment for forming a primer, both applied as the next processes following the hot-dip glavanizing treatment of the steel strip.

In accordance with one of the features of the present invention, there is provided a method for continuously hot-dip galvanizing a steel strip, which comprises the steps of:

Continuously introducing a steel strip into a hot-dip galvanizing bath containing aluminum in a hot-dip galvanizing tank to subject said steel strip to a hot-dip galvanizing treatment; and, adjusting the thickness of a galvanized layer formed on the surface of said steel strip to a prescribed value directly above the surface of said hot-dip galvanizing bath to manufacture a hot-dip galvanized steel strip;

said method being characterized by:

dividing said hot-dip galvanizing tank into a plating chamber and a reaction chamber by a vertical partition having a gap at the lowermost end thereof and an opening-adjustable aperture at the upper end portion thereof;

forming the bottom wall of said plating chamber so as to incline downwardly toward the bottom wall of said reaction chamber, said plating chamber and said reaction chamber communicating with each other through said gap and said aperture;

causing said hot-dip galvanizing bath contained in said hot-dip galvanizing tank to circulate by convection, under the effect of stirring by a stirring means provided in said reaction chamber, through said gap and said aperture, between said plating chamber and said reaction chamber;

continuously introducing a steel strip into said hot-dip galvanizing bath in said plating chamber while continuing said stirring, to subject said steel strip to a hot-dip galvanizing treatment;

on the other hand, causing the bottom dross ($FeZn_7$) produced in said plating chamber during said hot-dip galvanizing treatment and accumulated on the bottom of said plating chamber, to flow down along the slant bottom wall of said plating chamber to the bottom of said reaction chamber;

causing said bottom dross to actively react with aluminum contained in said hot-dip galvanizing bath in said reaction chamber under the effect of said stirring by said stirring means, to convert said bottom dross into a surface dross ($Fe_2Al_5$); and, substantially removing said surface dross floating on the surface of said hot-dip galvanizing bath in said reaction chamber, from said reaction chamber, during said hot-dip galvanizing treatment,

BRIEF DESCRIPTION OF THE DRAWINGS

FIG. 3 is a graph illustrating the relationship between the Al content in the entire galvanized layer and the thickness of the galvanized layer, for a hot-dip galvanized steel strip prepared while stirring a hot-dip galvanizing bath containing Al in the hot-dip galvanizing tank of the experimental hot-dip galvanizing apparatus of FIG. 1;

FIG. 4 is a schematic sectional view illustrating an embodiment of the hot-dip galvanizing apparatus used in the method for continuously hot-dip galvanizing a steel strip of the present invention; and, FIG. 5 is a sectional view of FIG. 4 cut along the line A—A.

DETAILED DESCRIPTION OF PREFERRED EMBODIMENTS

From the aforementioned point of view, we conducted various tests and investigations in an attempt to develop a method and an apparatus for continuously hot-dip galvanizing a steel strip capable of minimizing the Al concentration of a hot-dip galvanizing bath, and still effectively inhibiting production of the bottom dross.

First, with a view to effectively converting a bottom dross ($FeZn_7$) into a surface dross ($Fe_2Al_5$) through acceleration of the reaction of the bottom dross produced during hot-dip galvanizing of a steel strip with Al, we carried out a test comprising subjecting a steel strip to a hot-dip galvanizing treatment while stirring a hot-dip galvanizing bath containing Al.

Figure 1:
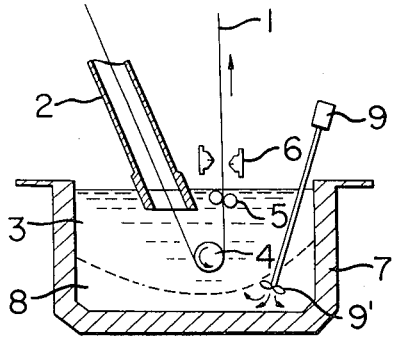
FIG. 1 is a schematic sectional view illustrating an experimental hot-dip galvanizing apparatus used in an acceleration test of reaction of bottom dross with Al contained in a hot-dip galvanizing bath.

FIG. 1 is a schematic sectional view of the experimental hot-dip galvanizing apparatus used in the above-mentioned test. In FIG. 1, 7 is a hot-dip galvanizing tank containing a hot-dip galvanizing bath 3; 1 is a steel strip; 2 is a chute, provided above the hot-dip galvanizing tank 7, for introducing the steel strip 1 into the hot-dip galvanizing bath 3; 4 is a sink roll, provided in the hot-dip galvanizing bath 3, for reversing upwardly the travelling direction of the steel strip 1; 5 are a pair of pinch rolls, provided in the hot-dip galvanizing bath 3 and adjacent to the surface thereof, for holding the steel strip 1; 6 are a pair of slit nozzles, provided immediately above the surface of the hot-dip galvanizing bath 3, for ejecting a gas against the surface of the steel strip 1 for the purpose of adjusting the thickness of a galvanized layer formed on the surface of the steel strip 1; 8 is a bottom dross accumulated on the bottom of the hot-dip galvanizing tank 7; and 9 is a stirrer equipped with a corrosion resistant screw 9'.

A hot-dip galvanizing bath 3 containing Al with a free Al concentration of about 0.18 wt.% was contained in the hot-dip galvanizing tank 7 of the experimental hot-dip galvanizing apparatus shown in FIG. 1, having the above-mentioned structure, and the steel strip 1 was subjected to a conventional hot-dip galvanizing treatment, while stirring the hot-dip galvanizing bath 3 by rotating the screw 9' of the stirrer 9 at 200 r.p.m.

Figure 2:
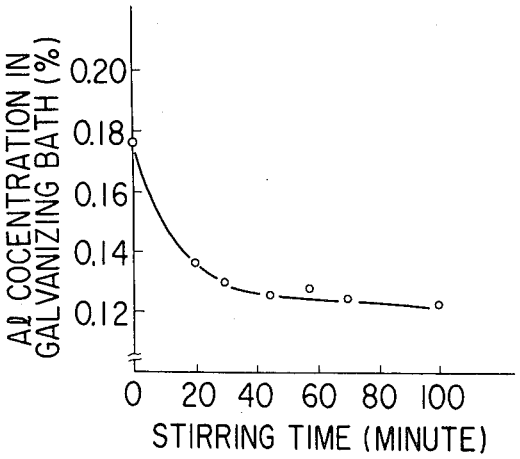
FIG. 2 is a graph illustrating changes with time in the free Al concentration in a hot-dip galvanizing bath in the case where a steel strip is hot-dip galvanized while stirring said hot-dip galvanizing bath containing Al in the hot-dip galvanizing tank of the experimental hot-dip galvanizing apparatus shown in FIG. 1.

FIG. 2 is a graph illustrating changes with time in the free Al concentration in the hot-dip galvanizing bath 3 during the above-mentioned hot-dip galvanizing treatment of the steel strip 1. As shown in FIG. 2, the free Al concentration in the hot-dip galvanizing bath 3 decreased with the lapse of time, reached about 0.13 wt.% after the lapse of about 60 minutes, and attained equilibrium. And, the bottom dross 8 was converted into a surface dross, which floated up onto the surface of the hot-dip galvanizing bath 3. Results of analysis of the surface dross revealed a ratio of Al to Fe of: $Al/Fe \approx 1$. Microscopic observation of the surface dross demonstrated a clear $Fe_2Al_5$ phase. The results of this test showed that stirring of the Al-containing hot-dip galvanizing bath in the hot-dip galvanizing tank accelerates the reaction of the bottom dross with Al in the bath, converting the bottom dross into the surface dross, which can be easily scraped out from the hot-dip galvanizing tank during the hot-dip galvanizing operation.

The Al content was investigated in the galvanized layer of the hot-dip galvanized steel strip obtained by hot-dip galvanizing the steel strip while stirring the Al-containing hot-dip galvanizing bath 3 in the manner as mentioned above. According to the results, the Al content in the surface layer of the galvanized layer was about 0.13 wt.%, i.e., at the same level as the free Al concentration in the hot-dip galvanizing bath having reached the equilibrium as mentioned above. This value was lower than the Al content of from 0.14 to 0.20 wt.% observed in the surface layer of the galvanized layer without stirring of the hot-dip galvanizing bath. This fact also suggested that the reaction of the bottom dross with Al in the hot-dip galvanizing bath reached the equilibrium.

As described above, the Al content in the surface layer of the galvanized layer substantially agrees with the free Al concentration in the hot-dip galvanizing bath, whereas the Al content in the entire galvanized layer is higher than the free Al concentration in the hot-dip galvanizing bath. This is attributable to the formation of an $Fe_2Al_5$ layer at the boundary between the Fe layer and the Zn layer of the hot-dip galvanized steel strip. A larger amount of this $Fe_2Al_5$ layer thus formed leads to a higher Al content in the entire galvanized layer. In an actual operation, however, conditions for the formation of the $Fe_2Al_5$ layer between the Fe layer and the Zn layer of a hot-dip galvanized steel strip, for example, the residence time of the steel strip in the hot-dip galvanizing bath (i.e., the line speed) and the temperature of the hot-dip galvanizing bath, are limited within a relatively tight range. The relationship was therefore investigated between the Al content in the entire galvanized layer and the thickness of the galvanized layer, for the above-mentioned hot-dip galvanized steel strip prepared while stirring the hot-dip galvanizing bath.

FIG. 3 is a graph illustrating the results of the above-mentioned test. It was ascertained from FIG. 3 that the Al content in the entire galvanized layer is inversely proportional to the thickness, i.e., the deposited amount of the galvanized layer. More specifically, once an $Fe_2Al_5$ layer in a certain amount is formed in the galvanized layer, the increase in the thickness of the galvanized layer, if any, does not lead to an increase in the amount of $Fe_2Al_5$ layer, but to an increase in the amount of coated Zn.

Then, we conducted a test of hot-dip galvanizing a steel strip while controlling the free Al concentration in the hot-dip galvanizing bath to a value required in an actual operation. In an actual operation, a part of Al contained in the hot-dip galvanizing bath is consumed by the reaction with Fe. With this fact in view, the free Al concentration necessary for converting the bottom dross into the surface dross was determined for various levels of the thickness of galvanized layer, taking into consideration the Al consumption in the above-mentioned reaction with Fe, and thus the amount of Al to be added to the hot-dip galvanizing bath was controlled. The steel strip was subjected to the hot-dip galvanizing treatment while stirring as mentioned above the hot-dip galvanizing bath thus under the control of Al addition.

As a result of the hot-dip galvanizing treatment carried out by the method described above, the Al concentration in the hot-dip galvanizing bath could be kept within the range of from 0.14 to 0.18 wt.% even with different thicknesses of the galvanized layer of the steel strip. The bottom dross ($FeZn_7$) was converted into the surface dross ($Fe_2Al_5$) by the reaction with Al. While, in the conventional operation, the free Al concentration in a hot-dip galvanizing bath had to be at least 0.45 wt.% to avoid the production of bottom dross, an Al concentration in the hot-dip galvanizing bath of 0.32 wt.% sufficed, according to the method described above. There was therefore a reduction in the amount of Fe dissolved from the steel strip coming into the hot-dip galvanizing bath, the sink roll, the pinch rolls and other devices immersed in the hot-dip galvanizing bath. As a result, surface irregularities of the sink roll and the pinch rolls caused by non-uniform corrosion largely decreased, thus leading to an improved appearance of the product. Also, adverse effects were eliminated on the galvannealing treatment of the galvanized layer and the chemical treatment for forming a primer coat of the hot-dip galvanized steel strip, as the next processes.

However, the method comprising stirring the hot-dip galvanizing bath and the method comprising controlling the Al concentration in the hot-dip galvanizing bath described above, although having the effect of solving the problems involved in the conventional art, were problematic in the following points:

(1) In the method comprising stirring the hot-dip galvanizing bath, the bottom dross accumulated on the bottom of the hot-dip galvanizing tank curls up under the effect of stirring of the hot-dip galvanizing bath and adheres to the surface of the galvanized layer of the hot-dip galvanized steel strip, thus causing surface defects in the product.

(2) In the method comprising controlling the free Al concentration in the hot-dip galvanizing bath to a value necessary for the actual operation, it is necessary to control the amount of Al to be added to the hot-dip galvanizing bath in response to the thickness of the galvanized layer. However, since addition of Al to the hot-dip galvanizing bath is effected by using a zinc ingot containing Al, proper control of the amount of Al added to the hot-dip galvanizing bath mentioned above requires to make available many kinds of zinc ingots with different Al contents, and this is not practical at all.

(3) Long-term hot-dip galvanizing operations, if carried out by the method of controlling the free Al content in the hot-dip galvanizing bath to a value necessary for the actual operation, cause dispersion of a part of the surface dross throughout the hot-dip galvanizing bath. Because this seriously increases the viscosity of the hot-dip galvanizing bath, the surface dross and the hot-dip galvanizing bath are solidified at locations where the flow of the hot-dip galvanizing bath in the galvanizing tank stagnates, such as behind the supports of the sink roll and the pinch rolls. This solidification adversely affects the hot-dip galvanizing operation and the surface dross discharging operation.

The present invention was made, based on the findings as mentioned above, and the method for continuously hot-dip galvanizing a steel strip of the present invention comprises the steps of:

continuously introducing a steel strip into a hot-dip galvanizing bath containing aluminum contained in a hot-dip galvanizing tank to subject said steel strip to a hot-dip galvanizing treatment; and, adjusting the thickness of a galvanized layer formed on the surface of said steel strip immediately to a prescribed directly above the surface of said hot-dip galvanizing bath to manufacture a hot-dip galvanized steel strip;

said method being characterized by:

dividing said hot-dip galvanizing tank into a plating chamber and a reaction chamber by a vertical partition having a gap at the lowermost end thereof and an opening-adjustable aperture at the upper end portion thereof;

forming the bottom wall of said plating chamber so as to incline downwardly toward the bottom wall of said reaction chamber, said plating chamber and said reaction chamber communicating with each other through said gap and said aperture;

causing said hot-dip galvanizing bath contained in said hot-dip galvanizing tank to circulate by convection, under the effect of stirring by a stirring means provided in said reaction chamber, through said gap and said aperture, between said plating chamber and said reaction chamber;

continuously introducing a steel strip into said hot-dip galvanizing bath in said plating chamber while continuing said stirring, to subject said steel strip to a hot-dip galvanizing treatment;

on the other hand, causing a bottom dross ($FeZn_7$) produced in said plating chamber during said hot-dip galvanizing treatment and accumulated on the bottom of said plating chamber, to flow down along the slant bottom wall of said plating chamber to the bottom of said reaction chamber;

causing said bottom dross to actively react with aluminum contained in said hot-dip galvanizing bath in said reaction chamber under the effect of said stirring by said stirring means, to convert said bottom dross into a surface dross ($Fe_2Al_5$); and, substantially removing said surface dross, floating on the surface of said hot-dip galvanizing bath in said reaction chamber, from said reaction chamber, during said hot-dip galvanizing treatment.

Now, the method and the apparatus for continuously hot-dip galvanizing a steel strip of the present invention is described in more detail with reference to the drawings.

FIG. 4 is a schematic sectional view illustrating an embodiment of the hot-dip galvanizing apparatus used in the method for continuously hot-dip galvanizing a steel strip of the present invention; and, FIG. 5 is a sectional view of FIG. 4 cut along the line A—A. In FIGS. 4 and 5, 7 is a hot-dip galvanizing tank containing a hot-dip galvanizing bath 3. The hot-dip galvanizing tank 7 is divided by a vertical partition 12 into a plating chamber 10 and a reaction chamber 11. The bottom wall 10' of the plating chamber 10 inclines downwardly toward the reaction chamber 11 and is connected to the horizontal bottom wall 11' of the reaction chamber 11, which is lower than the bottom wall 10. The lowermost end of the vertical partition 12 is located apart from the bottom wall 10' of the plating chamber 10, thus forming a prescribed gap 12' between the lowermost end of the vertical partition 12 and the bottom wall 10'. At a corner of the upper end portion of the vertical partition 12, an aperture 14 is formed. The opening of the aperture 14 is freely adjustable by operating up and down a weir 15. The plating chamber 10 and the reaction chamber 11 are therefore communicated with each other through the gap 12' and the aperture 14.

A chute 2 for introducing a steel strip into the hot-dip galvanizing bath 3 in the plating chamber 10 is provided above the plating chamber 10. A sink roll 4 for reversing upwardly the travelling direction of the steel strip and a pair of pinch rolls 5 for holding the steel strip 1 are provided in the hot-dip galvanizing bath 3 in the plating chamber 10. A pair of slit nozzles 6 for blowing a gas to the surface of the steel strip 1 for adjusting the thickness of the galvanized layer formed on the surface of the steel strip 1 are provided directly above the hot-dip galvanizing bath 3 in the plating chamber 10. A stirrer 9 is provided in the reaction chamber 11. The stirrer 9 has at the top end thereof a corrosion resistant screw 9' rotating by a motor, and the screw 9' is located, in the reaction chamber 11, near the bottom wall 11' of the reaction chamber 11. In the reaction chamber 11, furthermore, a zinc ingot 13 containing Al in a prescribed amount is suspended by a suspension hook 17 so as to be immersed in the hot-dip galvanizing bath 3 in the reaction chamber 11.

In the above-mentioned hot-dip galvanizing apparatus, the steel strip 1 is introduced into the hot-dip galvanizing bath 3 in the plating chamber 10 through the chute 2 while rotating the screw 9' of the stirrer 9. The steel strip 1, of which the travelling direction is reversed upwardly by the sink roll 4, passes through the pair of pinch rolls 5, and then through the pair of slit nozzles 6 provided directly above the hot-dip galvanizing bath 3. The thickness of the galvanized layer formed on the surface of the steel strip 1 is adjusted by the gas blown from the pair of slit nozzles 6, and thus a hot-dip galvanized steel strip is manufactured.

The bottom dross ($FeZn_7$) 8 produced in the plating chamber 10 during the above-mentioned hot-dip galvanizing operation and accumulated on the bottom wall 10', slowly flows down through the gap 12' along the descending slope of the bottom wall 10' into the reaction chamber 11, where the bottom dross 8 reacts actively with Al contained in the hot-dip galvanizing bath 3 in the reaction chamber 11 under the stirring effect exerted by the screw 9' of the stirrer 9 and is converted into the surface dross ($Fe_2Al_5$) 16 which floats up onto the surface of the hot-dip galvanizing bath in the reaction chamber 11. In the plating chamber 10, the reaction of the bottom dross 8 with Al contained in the hot-dip galvanizing bath 3 is in equilibrium, and the free Al concentration in the hot-dip galvanizing bath 3 is kept within the range of from 0.12 to 0.14 wt.%. The hot-dip galvanizing bath 3 in the hot-dip galvanizing tank 7 circulates by convection, under the stirring effect of the stirrer 9, from the plating chamber 10, through the gap 12', into the reaction chamber 11, and from the reaction chamber 12, through the aperture 14, into the plating chamber 10, as shown by the arrows in the drawing. The surface dross 16 floating on the surface of the hot-dip galvanizing bath 3 in the reaction chamber 11, being dammed up by the weir 15, never flows into the plating chamber 10. There is therefore almost no risk of the surface dross adhering to the surface of the hot-dip galvanized steel strip 1.

Addition of Al to the hot-dip galvanizing bath 3 is accomplished by immersing the zinc ingot 13 containing Al in a prescribed amount into the hot-dip galvanizing bath 3 in the reaction chamber 11. The Al content in the zinc ingot 13 may be within the range of from 0.25 to 0.40 wt.%. This range of Al contents in the zinc ingot 13 is selected on the basis of the aforementioned test results on the relationship between the Al content in the entire galvanized layer and the thickness of the galvanized layer, and agrees with average Al requirements corresponding to the thickness of the galvanized layer during an operating period. As a result, the extent of the thickness of the galvanized layer leads to an excess or a shortage of Al content in the hot-dip galvanizing bath 3, which in turn results in fluctuations in the amount of the bottom dross 8 accumulated in the reaction chamber 11. However, because the amount of accumulated bottom dross itself is slight and the bottom dross 8 is present only in the reaction chamber 11, no adverse effect is exerted on the hot-dip galvanized steel strip 1.

Due to the fact that the reaction of the bottom dross 8 with Al in the hot-dip galvanizing bath 3 is in equilibrium, the free Al concentration in the hot-dip galvanizing bath 3 in the plating chamber 10 is kept within the range of from 0.12 to 0.14 wt.% as described above. With a free Al concentration of under 0.12 wt.%, the production of bottom dross 8 tends to increase, whereas, with a free Al concentration of largely over 0.14 wt.%, the amount of Fe dissolution from the steel strip 1, the sink roll 4, the pinch rolls 5 and other devices tends to increase. The free Al concentration in the hot-dip galvanizing bath 3 in the plating chamber 10 should therefore preferably be within the range of from 0.12 to 0.14 wt.%.

The surface dross 16 floating on the surface of the hot-dip galvanizing bath 3 in the reaction chamber 11 can be easily removed from the reaction chamber 11 without interrupting the hot-dip galvanizing operation by bailing out with, for example a ladle. The surface dross may be produced also in the plating chamber 10 in a slight amount during the hot-dip galvanizing operation and float up onto the surface of the hot-dip galvanizing bath 3 in the plating chamber 10. There is however no risk of this surface dross adhering to the surface of the hot-dip galvanized steel strip 1, since not only the amount of production of this surface dross is slight, but also this surface dross can also be easily removed from the plating chamber 10 without interrupting the hot-dip galvanizing operation by bailing out with a ladle or the like as in the case of the surface dross 16 produced in the reaction chamber 11.

Even when the amount of produced bottom dross 8 increases due to the breakage of the reaction equilibrium between the bottom dross 8 and the Al in the hot-dip galvanizing bath 3 during the hot-dip galvanizing operation of the steel strip 1, the bottom dross 8 is accumulated on the bottom of the reaction chamber 11, and is hardly accumulated on the bottom of the plating chamber 10. The bottom dross accumulated on the bottom of the reaction chamber 11 can therefore be bailed out from the reaction chamber 11 without interrupting the hot-dip galvanizing operation. The opening of the aperture 14 provided at a corner of the upper end portion of the vertical partition 12 separating the plating chamber 10 and the reaction chamber 11 is freely adjustable by moving the weir 15 up and down as mentioned above. By adjusting the opening of the aperture 14 in accordance with the amount of produced surface dross 16 in the reaction chamber 11, it is possible to prevent the surface dross 16 from flowing from the reaction chamber 11 to the plating chamber 10. The stirrer 9 provided in the reaction chamber 11 may be replaced by a pump for stirring molten metal, an electro-magnetic pump, or an inductor.

Now, the present invention is described in more detail by means of an example.

EXAMPLE

The hot-dip galvanizing apparatus having the structure described above with reference to FIGS. 4 and 5 was used. The hot-dip galvanizing tank 7 contained a hot-dip galvanizing bath 3 in an amount of 150 tons having a free Al concentration of from 0.16 to 0.18 wt.%. The hot-dip galvanizing bath 3 filled, through the gap 12' and the aperture 14, the plating chamber 10 and the reaction chamber 11. The bottom wall of the plating chamber 10 had an inclination angle of 30°. The hot-dip galvanizing bath 3 was caused to circulate at a rate of 100 tons/hour by rotating the screw 9' of the stirrer 9 at 200 r.p.m.

Under the above-mentioned conditions, a steel strip 1 having a width of 914 mm and a thickness of 0.4 mm was continuously introduced into the hot-dip galvanizing bath 3 in the plating chamber 10 through the chute 2 at a speed of 80 m/minute while rotating the screw 9' of the stirrer 9. The steel strip 1 travelled through the sink roll 4 and the pinch rolls 5, and the thickness of the galvanized layer thereof was adjusted to 230 g/m$^2$ by a gas blown from the pair of slit nozzles 6 directly above the surface of the hot-dip galvanizing bath 3. A hot-dip galvanized steel strip was thus manufactured.

As a result of the above-mentioned hot-dip galvanizing operation, the free Al concentration in the hot-dip galvanizing bath 3 in the plating chamber 10 became 0.14 wt.%. Therefore, the bottom dross ($FeZn_7$) 8 produced in the plating chamber 10 and accumulated on the bottom wall 10' flowed down along the slope of the bottom wall 10' through the gap 12' into the reaction chamber 11 almost without reacting with Al, The bottom dross 8 which had flowed into the reaction chamber 11 actively reacted with Al in the hot-dip galvanizing bath 3 in the reaction chamber 11 under the stirring effect of the stirrer 9 and became surface dross ($Fe_2Al_5$) 16 which floated up onto the surface of the hot-dip galvanizing bath 3 in the reaction chamber 11.

The surface dross 16 having floated up onto the surface of the hot-dip galvanizing bath 3 could be easily removed from the reaction chamber 11 from time to time by bailing out with a ladle without any trouble in the hot-dip galvanizing operation. Almost no surface dross adhered to the surface of the manufactured hot-dip galvanized steel strip 1, and the appearance of the product was not impaired. Since the free Al concentration in the hot-dip galvanizing bath 3 in the plating chamber 10 was kept low, there was only a slight dissolution of Fe from the sink roll 4, the pinch rolls 5 and other devices immersed in the hot-dip galvanizing bath 3. This inhibited the production of surface irregularities on the sink roll 4 and the pinch rolls 5, thus achieving an excellent appearance of the manufactured hot-dip galvanized steel strip.

According to the method and the apparatus for continuously hot-dip galvanizing a steel strip of the present invention, as described above in detail, the following many industrially useful effects as provided:

(1) The bottom dross produced during the hot-dip galvanizing operation of the steel strip 1 in the plating chamber 10 is converted into the surface dross in the separated reaction chamber 11. Therefore, not only it is possible to remove the surface dross from time to time without interrupting the hot-dip galvanizing operation, but also there is no risk of the surface dross adhering to the surface of the manufactured hot-dip galvanized steel strip, and of thus impairing the appearance of the product.

(2) Because of the low free Al concentration in the hot-dip galvanizing bath 3 in the plating chamber 10, there is little dissolution of Fe from the steel strip, the sink roll, the pinch rolls and other devices immersed in said hot-dip galvanizing bath. Surface irregularities do not occur on the sink roll and the pinch rolls, thus permitting avoidance of flaws on the manufactured hot-dip galvanized steel strip.

(3) Also because of the low free Al concentration in the hot-dip galvanizing bath 3 in the plating chamber 10, the $Fe_2Al_5$ layer is thin in the galvanized layer of the manufactured hot-dip galvanized steel strip. No trouble is therefore caused in the galvannealing treatment of the galvanized layer and the chemical treatment for forming a primer coat, as the next processes.

What is claimed is:

1. A method for continuously hot-dip galvanizing a steel strip, which comprises the steps of:

continuously introducing a steel strip into a hot-dip galvanizing bath containing aluminum in a hot-dip galvanizing tank to subject said steel strip to a hot-dip galvanizing treatment; and, adjusting the thickness of a galvanized layer formed on the surface of said steel strip to a prescribed value directly above the surface of said hot-dip galvanizing bath to manufacture a hot-dip galvanized steel strip;

said method being characterized by:

providing a hot-dip galvanizing tank which is divided into a plating chamber and a reaction chamber by a vertical partition having a gap at the lowermost end thereof and an opening-adjustable aperture at the upper end portion thereof, the bottom wall of said plating chamber being inclined downwardly toward the bottom wall of said reaction chamber, said plating chamber and said reaction chamber communicating with each other through said gap and said aperture;

circulating said hot-dip galvanizing bath contained in said hot-dip galvanizing tank by convection, under the effect of stirring by a stirring means provided in said reaction chamber, through said gap and said aperture, between said plating chamber and said reaction chamber;

continuously introducing a steel strip into said hot-dip galvanizing bath in said plating chamber while continuing said stirring, to subject said steel strip to a hot-dip galvanizing treatment and also forming bottom dross ($FeZn_7$) in said plating chamber during said hot-dip galvanizing treatment which accumulates on the bottom of said plating chamber and flows down along the slant bottom wall of said plating chamber to the bottom of said reaction chamber;

providing aluminum in said hot-dip galvanizing bath in said reaction chamber and actively reacting said bottom dross in said reaction chamber with said aluminum under the effect of said stirring by said stirring means, to convert said bottom dross into a surface dross ($Fe_2Al_5$) which floats to the surface; and substantially removing said surface dross floating on the surface of said hot-dip galvanizing bath in said reaction chamber, from said reaction chamber, during said hot-dip galvanizing treatment.

2. The method as claimed in claim 1, wherein:

the free aluminum concentration in said hot-dip galvanizing bath in said plating chamber is kept within the range of from 0.12 to 0.14 wt.%, thereby maintaining the equilibrium reaction of said bottom dross with aluminum in said hot-dip galvanizing bath in said plating chamber.

3. The method as claimed in claim 1 or 2, wherein:

a zinc ingot containing aluminum within the range of from 0.25 to 0.40 wt.% is immersed in said hot-dip galvanizing bath in said reaction chamber, to replenish zinc and aluminum consumed during said hot-dip galvanizing treatment.

4. In an apparatus for continuously hot-dip galvanizing a steel strip in accordance with the method of claim 1, which comprises:

a hot-dip galvanizing tank for containing a hot-dip galvanizing bath; a sink roll and a pair of pinch rolls provided in said hot-dip galvanizing tank, said sink roll and said pair of pinch rolls being immersed in said hot-dip galvanizing bath contained in said hot-dip galvanizing tank; and means for adjusting the thickness of a galvanized layer formed on the surface of a steel strip, said adjusting means being located directly above the surface of said hot-dip galvanizing bath;

the improvement comprising:

a substantially vertical partition in said hot-dip galvanizing tank for dividing said galvanizing tank into a plating chamber and a reaction chamber, said sink roll and said pair of pinch rolls being located in said plating chamber;

the galvanizing tank having a bottom wall comprising an inclined portion which defines the bottom wall of said plating chamber and which inclines downwardly toward the reaction chamber, and a substantially horizontal portion connected to the inclined bottom wall of said plating chamber and defining the bottom wall of said reaction chamber, said bottom wall of said reaction chamber being lower than said bottom wall of said plating chamber, the lowermost end of said vertical partition being located spaced from said bottom wall of said plating chamber so as to form a prescribed gap between the lowermost end of said vertical partition and said bottom wall of said plating chamber;

said vertical partition having an aperture at the upper end portion thereof;

a weir communicating with said aperture of said vertical partition for adjusting the opening of said aperture said plating chamber and said reaction chamber communicating with each other through said gap and said aperture; and, stirring means, provided in said reaction chamber for stirring the hot-dip galvanizing bath contained in said galvanizing tank and for causing said hot-dip galvanizing bath to circulate by convection through said gap and said aperture between said plating chamber and said reaction chamber, and to stir, together with said hot-dip galvanizing bath, a bottom dross produced in said plating chamber during hot-dip galvanizing of a steel strip in said plating chamber, said dross having flowed down along the slant bottom wall of said plating chamber to the bottom of said reaction chamber.

5. The apparatus as claimed in claim 4, wherein:

said stirring means comprises a stirrer having a screw at an end thereof, said screw being located in said reaction chamber near the bottom wall of said reaction chamber.

6. The apparatus as claimed in claim 4, wherein:

said stirring means comprises a pump for stirring molten metal, said pump being located, in said reaction chamber near the bottom wall of said reaction chamber.

7. The apparatus as claimed in claim 4, wherein:

said stirring means being an inductor, said inductor is located adjacent to a outer surface of the side wall of said reaction chamber.

* * * * *